US006448359B1

(12) United States Patent
Kavesh

(10) Patent No.: US 6,448,359 B1
(45) Date of Patent: Sep. 10, 2002

(54) HIGH TENACITY, HIGH MODULUS FILAMENT

(75) Inventor: Sheldon Kavesh, Whippany, NJ (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 09/537,461

(22) Filed: Mar. 27, 2000

(51) Int. Cl.[7] ..... C08F 110/02
(52) U.S. Cl. ..... 526/352; 525/55
(58) Field of Search ..... 526/352; 525/55

(56) References Cited

U.S. PATENT DOCUMENTS

| | | | | |
|---|---|---|---|---|
| 4,413,110 A | | 11/1983 | Kavesh et al. | 526/348.1 |
| 4,663,101 A | | 5/1987 | Kavesh et al. | 264/178 |
| 5,578,374 A | | 11/1996 | Dunbar et al. | 428/364 |
| 5,736,244 A | | 4/1998 | Kavesh et al. | 428/364 |
| 5,741,451 A | * | 4/1998 | Dunbar et al. | 264/103 |

FOREIGN PATENT DOCUMENTS

| | | | |
|---|---|---|---|
| EP | 0 213 208 | | 3/1987 |
| EP | 0213208 | * | 8/1987 |
| JP | 59-216913 | | 7/1984 |
| WO | WO 89 00213 | | 1/1989 |
| WO | WO 00 48821 | | 8/2000 |

OTHER PUBLICATIONS

Y.E. Kwon et al., "Melting and Heat Capacity of Gel–Spun, Ultra–High Molar Mass Polyethylene Fibers", Elsevier Science Publishers B.V. GB, Polymer, vol. 41, No. 16, Jul. 2000, pp. 6237–6249.

Polymer Science USSR, vol. 26, No. 9, "Model of the Orientation Reinforcement of Polymers and the Preparation of High–Strength Polyethylene Fibers", Savitskii et al., pp. 2007–2016, 1984.

B.D. Coleman, "Statistics and Time Dependence of Mechanical Breakdown in Fibers", *Journal of Appplied Physics*, vol. 29, No. 6, 968–983 ((1958).

S.L. Phoenix, "Stochastic Strength and Fatique of Fiber Bundles", *International Journal of Fracture*, vol. 14, No. 3, 327–344 (1978).

* cited by examiner

*Primary Examiner*—David W. Wu
*Assistant Examiner*—William K Cheung
(74) *Attorney, Agent, or Firm*—Virginia Szigeti; Roger H. Criss; Margaret S. Millikin

(57) ABSTRACT

Polyethylene solutions are extruded through a multi-orifice spinneret into a cross-flow gas stream to form a fluid product. The fluid product is stretched at a temperature at which a gel will form at a stretch ratio of at least 5:1 over a length of less than about 25 mm with the cross-flow gas stream velocity at less than about 3 m/min. The fluid product is quenched in a quench bath consisting of an immiscible liquid to form a gel. The gel is stretched. The solvent is removed from the gel to form a xerogel and the xerogel product is stretched in at least two stages to produce a polyethylene yarn characterized by a tenacity of at least 35 g/d, a modulus of at least 1600 g/d and a work to break of at least 65 J/g. The yarn is further characterized by having greater than about 60% of a high strain orthorhombic crystalline component and, optionally, a monoclinic crystalline component greater than about 2% of the crystalline content. Composite panels made with these yarns exhibit excellent ballistic resistance, e.g., SEAC of 300 J-m$^2$/Kg or higher against 0.38 caliber bullets using test procedure NILECJ-STD-0101.01.

9 Claims, 5 Drawing Sheets

22 CALIBER STEEL FRAGMENT SIMULATOR PROJECTILES

HIGH TENACITY, HIGH MODULUS FILAMENT

BACKGROUND OF THE INVENTION

Polyethylene filaments, films and tapes are well known in the art. However, until recently, the tensile properties of such products have been generally unremarkable as compared to competitive materials such as polyamides and polyethylene terephthalate.

In recent years, many processes for the preparation of high tenacity filaments and films of high molecular weight polyolefins have been described. The present invention is an improvement of the processes and products described in U.S. Pat. Nos. 4,413,110, 4,663,101, 5,578,374, 5,736,244 and 5,741,451, each herein incorporated by reference in their respective entireties. Other processes are known and have been used to prepare single filaments of exceptionally high strength and modulus. For example, A. V. Savitski et. al. In Polymer Science U.S.S.R., 26, No. 9, 2007 (1984) report preparing a single polyethylene filament of 7.0 GPa (81.8 g/d) strength. In Japanese patent JP-A-59/216913 a single filament of 216 GPa (2524 g/d) modulus is reported. However, as is well known in the fiber spinning arts, the difficulty of producing strong yarns increases with increasing numbers of filaments.

It is an object of this invention to provide high tenacity, high modulus polyethylene multi-filament yarns having a unique and novel microstructure and very high toughness. Such multi-filament yarns are exceptionally efficient in absorbing the energy of a projectile in anti-ballistic composites.

Other objects of this invention along with its advantages will become apparent from the following description.

SUMMARY OF THE INVENTION

The present invention is directed to a method of preparing a high tenacity, high modulus multi-filament yarn comprising the steps of: extruding a solution of polyethylene and solvent having an intrinsic viscosity (measured in decalin at 135° C.) between about 4 dl/g and 40 dl/g through a multiple orifice spinneret into a cross-flow gas stream to form a fluid product; stretching the fluid product (above the temperature at which a gel will form) at a stretch ratio of at least 5:1 over a length of less than about 25, mm with the cross-flow gas stream velocity at less than about 3 m/min; quenching the fluid product in a quench bath consisting of an immiscible liquid to form a gel product, stretching the gel product; removing the solvent from the gel product to form a xerogel product substantially free of solvent; and stretching the xerogel product, with a total stretch ratio sufficient to product a polyethylene multi-filament yarn characterized by a tenacity of at least 35 g/d, a modulus of at least 1600 g/d, and a work-to-break of at least 65 J/g.

The method further comprises the step of stretching the fluid product at an extension rate of more than about 500 $min^{-1}$.

The extruding step preferably is carried out with a multi-orifice spinneret wherein each orifice possesses a tapered entry region followed by a region of constant cross-section and wherein the ratio of the length/transverse dimension is greater than about 10:1. Further, the length/transverse dimension may be greater than about 25:1.

The present invention further includes a polyethylene multi-filament yarn of about 12 to about 1200 filaments having a denier of about 0.5 to about 3 denier per filament (dpf), a yarn tenacity of at least about 35 g/d, a modulus of at least 1600 g/d, and a work-to-break of at least about 65 J/g. The microstructure of the multi-filament yarn contains a high strain orthorhombic crystalline component comprising more than about 60% of the orthorhombic crystalline component and it may have a monoclinic crystalline component greater than about 2% of the crystalline content. In a preferred embodiment, the yarn includes about 60 to about 480 polyethylene filaments having a denier of about 0.7 to about 2 dpf, a yarn tenacity of about 45 g/d, a modulus of about 2200 g/d, greater than about 60% of a high strain orthorhombic crystalline component, and a monoclinic crystalline component greater than about 2% of the crystalline content.

The present invention also includes a composite panel comprising a polyethylene multi-filament yarn having a tenacity of at least about 35 g/d, a modulus of at least 1600 g/d, a work-to-break of at least about 65 J/g wherein the yarn has greater than about 60% of a high strain orthorhombic crystalline component and the yarn has a monoclinic crystalline component greater than about 2% of the crystaline content.

The present invention further includes a ballistic resistant composite panel having an specific energy absorption of the composite (SEAC) of at least about 300 J-$m^2$/Kg against .38 caliber bullets using test procedure NILECJ-STD-0101.01.

DETAILED DESCRIPTION OF THE INVENTION

Figure 1:
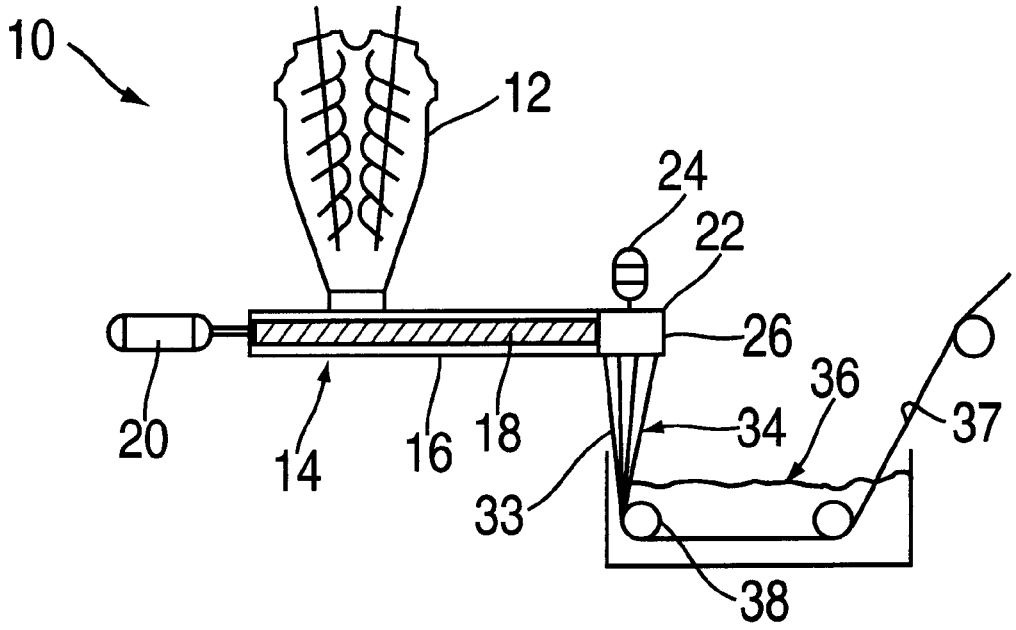
FIG. 1 is a schematic view of an apparatus used to prepare the products of the present invention.

There are many applications that require load-beating elements of high strength, modulus, toughness, dimensional and hydrolytic stability. For example, marine ropes and cables, such as mooring lines used to secure tankers to loading stations and the cables used to secure drilling platforms to underwater anchorage, are presently constructed of materials such as nylon, polyester, aramids and steel which are subject to hydrolytic or corrosive attack by sea water. Consequently such mooring lines and cables are constructed with significant safety factors and are replaced frequently. The greatly increased weight and the need for frequent replacement creates substantial operational and economic burdens. High tenacity, high modulus yarns are also used in the construction of anti-ballistic composites, in sports equipment, boat hulls and spars, high performance military and aerospaceapplications, high pressure vessels, hospital equipment, and medical applications including implants and prosthetic devices.

The present invention is an improved method of preparing a high tenacity, high modulus yarn. The polymer used in the present invention is crystallizable polyethylene. By the term "crystallizable" is meant a polymer which exhibits an x-ray diffraction pattern ascribable to a partially crystalline material.

Accordingly, the present invention is directed to a method of preparing high tenacity, high modulus multi-filament yarns that includes extruding a solution of polyethylene and solvent where the polyethylene has an intrinsic viscosity (measured in decalin at 135° C.) between about 4 dl/g and 40 dl/g through a multi-orifice spinneret into a cross-flow gas stream to form a multi-filament fluid product. The multi-filament fluid product is stretched, above the temperature at which a gel will form, and at a stretch ratio of at least 5:1, over a length less than about 25 mm with a cross-flow gas stream velocity of less than about 3 m/min. The fluid product is quenched in a quench bath consisting of an immiscible liquid to form a gel product. The gel product is stretched. The solvent is removed from the gel product to form a xerogel product substantially free of solvent. The xerogel product is stretched where the total stretch ratio is sufficient to product a polyethylene article having a tenacity of at least 35 g/d, a modulus of at least 1600 g/d, and a work-to-break of at least 65 J/g.

The term "xerogel" is derived by analogy to silica gel and as used herein means a solid matrix corresponding to the solid matrix of a wet gel with the liquid replaced by a gas (e.g. by an inert gas such as nitrogen or by air). This is formed when the second solvent is removed by drying under conditions that leaves the solid network of the polymer substantially intact.

The invention further includes the yarns produced by the above process. Such yarns and films have a unique and novel microstructure containing a high strain orthorhombic crystalline component comprising more than about 60% of the orthorhombic crystalline component and/or a monoclinic crystalline component exceeding 2% of the crystalline content. As will be discussed in the examples below, such yarns are exceptionally efficient in absorbing the energy of a projectile in an anti-ballistic composite. It will be understood that a "yarn" is defined as an elongated body comprising multiple individual filaments having cross-sectional dimensions very much smaller than their length. It will be further understood that the term yarn does not imply any restriction on the shapes of the filaments comprising the yarn or any restriction on the manner in which the filaments are incorporated in the yarn. The individual filaments may be of geometric cross-sections or irregular in shape, entangled or lying parallel to one another within the yarn. The yarn may be twisted or otherwise depart from a linear configuration.

The polyethylene used in the process of this invention has an intrinsic viscosity (IV) (measured in decalin at 135° C.) between about 4 and 40 dl/g. Preferable, the polyethylene has an IV between 12 and 30 dl/g.

The polyethylene may be made by several commercial processes such as the Zeigler process and may contain a small amount of side branches such as produced by incorporation of another alpha olefin such as propylene or 1-hexene. Preferably, the number of side branches as measured by the number of methyl groups per 1000 carbon atoms, is less than about 2. More preferably, the number of side branches is less than about 1 per 1000 carbon atoms. Most preferably the number of side branches is less than about 0.5 per 1000 carbon atoms. The polyethylene may also contain minor amounts, less than 10 wt % and preferably less than 5 wt %, of flow promoters, anti-oxidants, UV stabilizers and the like.

The solvent for the polyethylene used in this invention should be non-volatile under the spinning conditions. A preferred polyethylene solvent is a fully saturated white mineral oil with an initial boiling point exceeding 350° C., although other, lower boiling solvents such as decahydronaphthalne (decalin) may be used.

With reference now to FIG. 1, there is shown a schematic view of the apparatus 10 used to prepare the products of the present invention. The polyethylene solution or melt may be formed in any suitable device such as a heated mixer, a long heated pipe, or a single or twin screw extruder. It is necessary that the device be capable of delivering polyethylene solution to a constant displacement metering pump and thence to a spinneret at constant concentration and temperature. A heated mixer 12 is shown in FIG. 1 for forming the polyethylene solution. The concentration of polyethylene in the solution should be at least about 5 wt %.

The polyethylene solution is delivered to an extruder 14 containing a barrel 16 within which there is a screw 18 operated by a motor 20 to deliver polymer solution to a gear pump 22 at a controlled flow rate. A motor 24 is provided to drive the gear pump 22 and extrude the polymer solution through a spinneret 26. The temperature of the solution delivered to the extruder 14 and the spinneret 26 should be between 130° C. and 330° C. The preferred temperature depends upon the solvent and the concentration and molecular weight of the polyethylene. Higher temperatures will be used at higher concentrations and higher molecular weights. The extruder and spinneret temperature should be in the same range of temperatures and is preferably equal to or higher than the solution temperature.

Figure 2:
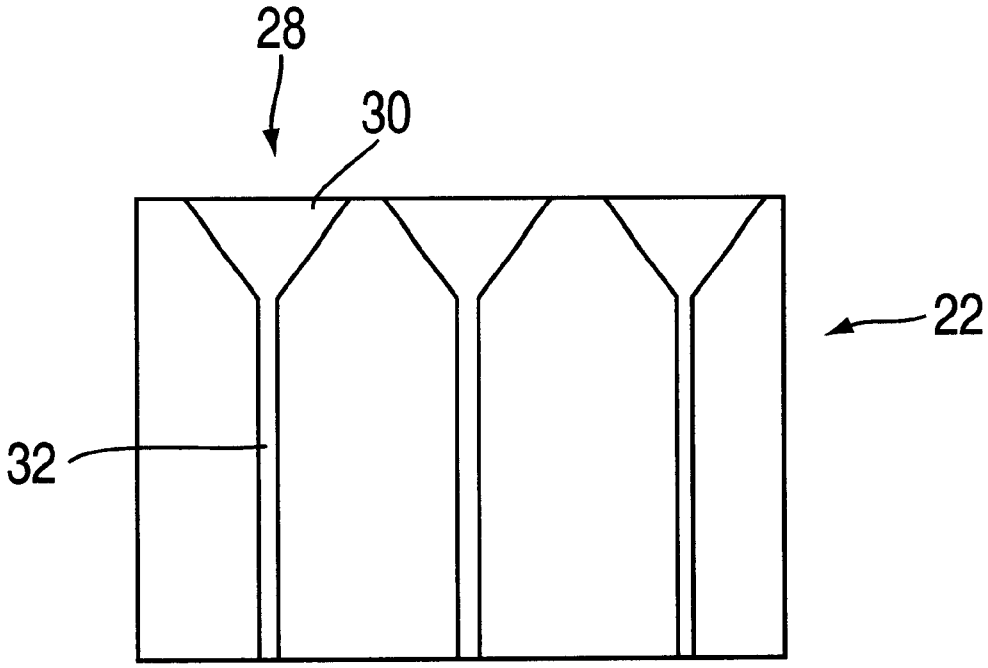
FIG. 2 is a cross-sectional view of an orifice of a spinneret in accordance with the present invention.

With reference now to FIG. 2 and continuing reference to FIG. 1, a cross-sectional view of an orifice of the spinneret 26 is shown. The spinneret holes 28 should have a tapered entry region 30 followed by a capillary region of constant cross-section 32 in which the length/diameter (L/D) ratio is more than about 10:1, preferably more than about 25:1 and most preferably more than about 40:1. The capillary diameter should be 0.2 to 2 mm preferably 0.5–1.5 mm.

The polyethylene solution is extruded from the spinneret 26 to form a multi-filament fluid product 33, the fluid product 33 passes through a spin gap 34 and into a quench bath 36 to form a gel 37. The dimension of the spin gap 34 between the spinneret 26 and the quench bath 36 must be less than about 25 mm, preferably less than about 10 mm and most preferably, the spin gap 34 is about 3 mm. To obtain the most uniform yarn with the highest tensile properties, it is essential that the spin gap 34 be constant and that perturbation of the surface of the quench bath 36 be minimal.

The gas velocity in the spin gap 34 is in a direction transverse to the fluid product, caused either by natural or forced convection, and must be less than about 3 m/min, preferably less than about 1 m/min. The transverse gas velocity in this region may be measured by a directional anemometer such as the Airdata Multimeter Model ADM-860 manufactured by Shortridge Instruments Inc., Scottsdale, Ariz.

The stretch ratio of the fluid product in the spin gap 34 ("jet draw") is measured by the ratio of the surface velocity of the first driven roller 38 to the velocity of the fluid product 33 issuing from the spinneret 26. This jet draw must be at least about 5:1, and is preferably at least about 12:1.

The quench liquid may be any liquid not miscible with the solvent used to prepare the polyethylene solution. Preferably, it is water or an aqueous medium with a freezing point below 0° C., such as aqueous brines or ethylene glycol solutions. It has been found detrimental to the properties of the product for the quench liquid to be miscible with the polyethylene solvent. The temperature of the quench bath should be in the range of about −20° C. to 20° C.

The critical aspects of the invention are the dimension of the spinneret holes, the stretch ratio of the fluid product in the gap between the die and the quench bath, the dimension of the spin gap and the cross-flow velocity of gas in the spin gap. These factors are most important in establishing the extension rate of the solution filaments in the spin gap and the quench rate in the quench bath. In turn, these factors are determinative of the resulting filament microstructure and its properties.

The extension rate of the fluid filaments in the spin gap may be calculated from the die exit velocity, the jet draw ratio and the dimension of the spin gap as below. The die exit velocity is the velocity of the fluid filaments at the exit of the spinneret holes (orifices).

Extension Rate, $min^{-1}$=Jet Draw Ratio×(Die Exit Velocity, mm/min−1)/Spin Gap, mm The extension rate of the fluid filaments in the spin gap should be at least about 500 $min^{-1}$ and is preferably more than about 1000 $min^{-1}$.

Once the gel leaves the quench bath, the gel is stretched maximally at room temperature. The spinning solvent may be extracted in a Sohxlet extractor by refluxing the gel in trichlorotrifluroethane. The gel is then dried and the xerogel is hot stretched in at least two stages at temperatures between about 120° C. and about 155° C.

The following examples are presented to more particularly illustrate the invention and are not to be construed as limitations thereon.

EXAMPLES 1–5

Comparative Examples A–O and Examples 1–5

An oil jacketed double helical (Helicone) mixer constructed by Atlantic Research Corporation was charged with 12 wt % linear polyethylene, 87.25 wt % mineral oil (Witco, "Kaydol") and 0.75 wt % antioxidant (Irganox B-225'). The linear polyethylene was Himont UHMW 1900 having an intrinsic viscosity of 18 dl/g and less than 0.2 methyl branches per 1000 carbon atoms. The charge was heated with agitation to 240° C. to form a uniform solution of the polymer. The bottom discharge opening of the mixer was adapted to feed the polymer solution first to a gear pump and then to a 16-hole spinneret maintained at 250° C. The holes of the spinneret were each of 1.016 mm diameter and 100:1 L/D. The gear pump speed was set to deliver 16 $cm^3$/min to the die.

The extruded solution filaments were passed through a spin gap in which they were stretched and then into a water quench bath at 9–12° C. An air flow velocity existed transverse to the filaments in the spin gap either as the result of natural convection or as maintained by a nearby blower. As the solution filaments entered the quench bath, they were quenched to a gel yarn. The gel filaments passed under a free-wheeling roller in the quench bath and out to a driven godet which set the stretch ratio in the spin gap.

The gel yarns leaving the water quench bath were stretched at room temperature and collected onto cores. The mineral oil was extracted from the gel yarns in a Sohxlet apparatus by means of refluxing trichlorotrifloroethane (TCTFE). The gel yarns were then air dried to xerogel yarns and hot stretched in two stages, first at 120° C. and then at 150° C. The stretch ratios were maximized in each stage of stretching of the gel yarns and the xerogel yarns.

Table I presents for several comparative examples (A–O), and Examples 1–5, the jet draw ratio of the fluid filaments in the spin gap, the length of the spin gap, the transverse air velocity in the spin gap and the extension rate in the spin gap. Table I also shows the solid state stretch ratio (equal to the product of the room temperature gel stretch ratio and the hot stretch ratios), the overall stretch ratio (equal to the jet draw ratio times the solid state stretch ratio) and the final yarn properties, measured by ASTM D2256, incorporated herein by reference. In the comparative examples A–O either the spin gap exceeded 25 mm, the jet draw was less than 5.0:1, the transverse air velocity was greater than 1 m/min or the extension rate in the spin gap was less than about 500 $^{1}$min. Also, in none of these comparative examples did the average yarn tenacity exceed 33 g/d nor did the average yarn modulus exceed 1840 g/d.

By way of contrast, in Examples 1–5 all of the above spinning conditions were satisfied. It will be seen that in Example 1, the jet draw was 6.0, the spin gap was 6.4 mm, the transverse air velocity was 0.76 m/min and the extension rate in the spin gap was 968 $min^{-1}$. As a result of these spinning conditions, the yarn tenacity was 38 g/d and the modulus was 2000 g/d.

In Examples 2–5, the transverse air velocity was maintained at 0.76 m/min, the spin gap was further reduced to 3.2 mm and the jet draw (ratio) was varied to be 9.8, 15, 22.7 and 33.8, respectively. It will be seen that the yarn tenacity increased to a maximum of 53 g/d and the yarn modulus peaked at 2430 g/d at a jet draw of 22.7.

TABLE I

| Comparative Example or Example No. | Jet Draw Ratio | Spin Gap, mm | Transverse Air Velocity, m/min | Extension Rate in Spin Gap, $min^{-1}$ | Solid State Stretch | Overall Stretch | Tenacity g/d | Modulus g/d |
|---|---|---|---|---|---|---|---|---|
| A | 1.1 | 6.4 | 0.76 | 19 | 49 | 54 | 32 | 1650 |
| B | 1.1 | 6.4 | 7.6 | 19 | 50 | 55 | 32 | 1590 |

TABLE I-continued

| Comparative Example or Example No. | Jet Draw Ratio | Spin Gap, mm | Transverse Air Velocity, m/min | Extension Rate in Spin Gap, $min^{-1}$ | Solid State Stretch | Overall Stretch | Tenacity g/d | Modulus g/d |
|---|---|---|---|---|---|---|---|---|
| C | 1.1 | 76.2 | 0.76 | 1.6 | 66 | 73 | 33 | 1640 |
| D | 1.1 | 76.2 | 7.6 | 1.6 | 62 | 68 | 30 | 1410 |
| E | 3 | 6.4 | 0.76 | 387 | 35 | 105 | 32 | 1655 |
| F | 3 | 6.4 | 7.6 | 387 | 25 | 75 | 28 | 1560 |
| G | 3 | 38.1 | 0.76 | 64 | 32 | 96 | 31 | 1690 |
| H | 3 | 38.1 | 7.6 | 64 | 25 | 75 | 27 | 1600 |
| I | 3 | 76.2 | 0.76 | 32 | 30 | 90 | 33 | 1904 |
| J | 3 | 76.2 | 7.6 | 32 | 24 | 72 | 28 | 1560 |
| K | 6 | 6.4 | 7.6 | 968 | 16 | 96 | 27 | 1370 |
| L | 6 | 38.1 | 0.76 | 161 | 22 | 132 | 31 | 1650 |
| M | 6 | 38.1 | 0.76 | 161 | 21 | 126 | 31 | 1890 |
| N | 6 | 76.2 | 0.76 | 81 | 18 | 108 | 27 | 1480 |
| O | 6 | 76.2 | 7.6 | 81 | 20 | 120 | 31 | 1840 |
| 1 | 6 | 6.4 | 0.76 | 968 | 27 | 162 | 38 | 2000 |
| 2 | 9.8 | 3.2 | 0.76 | 3400 | 24 | 235 | 42 | 2150 |
| 3 | 15 | 3.2 | 0.76 | 4340 | 30 | 450 | 47 | 2400 |
| 4 | 22.7 | 3.2 | 0.76 | 6760 | 28 | 636 | 53 | 2433 |
| 5 | 33.8 | 3.2 | 0.76 | 14,670 | 16 | 541 | 47 | 2370 |

EXAMPLE 6

Yarn Preparation and Tensile Properties

A co-rotating Berstorff twin screw extruder of 40 mm diameter and 43:1 L/D was fed with an 8.0 wt % slurry polyethylene in mineral oil. The polyethylene was of 27 IV and had no detectable branching (less than 0.2 methyls per 1000 C atoms). The polyethylene was dissolved in the mineral oil as it traversed the extruder. From the extruder, the polyethylene solution passed into a gear pump and then into a 60 filament spinneret maintained at 320° C. Each hole of the spinneret was of 1 mm diameter and of 40/1 L/D. The volumetric flow rate through each hole of the spinneret was 1 cc/min. The extruded solution filaments were passed through a 3.2 mm air gap in which they were stretched 15:1 and then into a water quench bath at 9° C. The air flow velocity transverse to the filaments in the spin gap as the result of natural convection was 0.8 m/min. As the solution filaments entered the quench bath, they were quenched to a gel yarn. The gel filaments passed under a free-wheeling roller in the quench bath and out to a driven godet which set the stretch ratio in the spin gap.

The gel yarn leaving the water quench bath was stretched 3.75:1 at room temperature, and passed into washer cabinets counter-current to a stream of trichlorotrifluroethane (CFC-113) at a temperature of 45° C. The mineral oil was extracted from the yarn and exchanged for CFC-113 by this passage. The gel yarn was stretched 1.26:1 in traversing the washers.

The gel containing CFC-113 was passed into a dryer cabinet at a temperature of 60° C. It issued from the dryer in a dry condition and had been additionally stretched 1.03:1.

The dry yarn was wound up into packages and transferred to a two stage stretch bench. Here it was stretched 5:1 at 136° C. and 1.5:1 at 150° C.

The tensile properties (ASTM D2256) of this 60 filament yarn were:

0.9 denier/filament;

45 g/d tenacity;

2190 g/d modulus; and

78 J/g work-to-break.

EXAMPLE 7

A. High Strain Crystalline Component

Figure 3A:
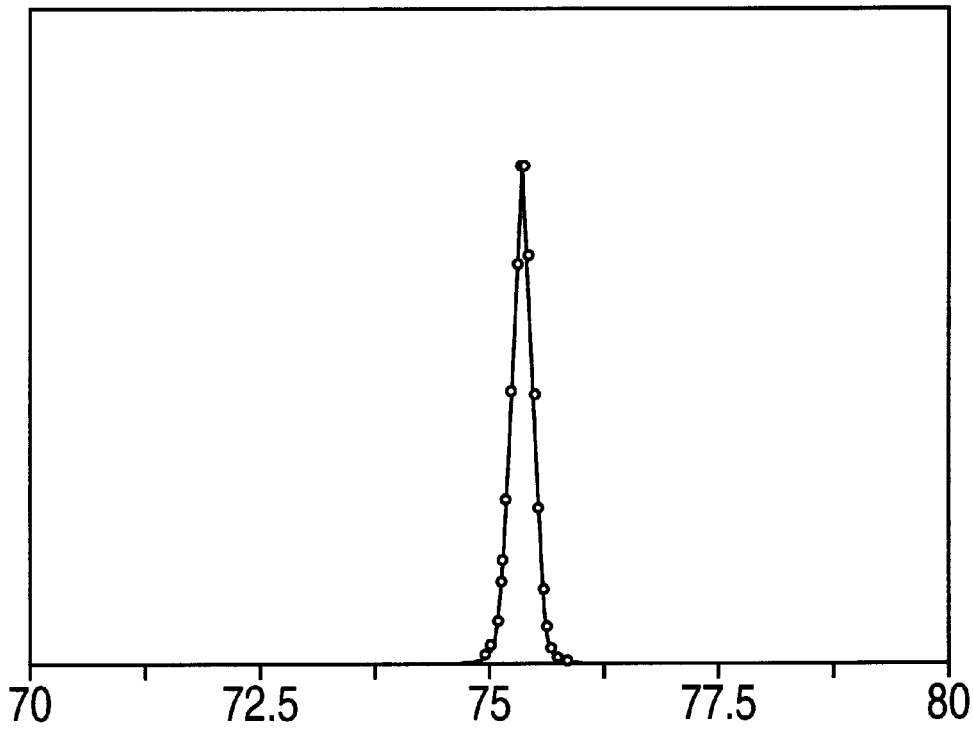
FIG. 3 shows the results from a wide angle x-ray diffraction study where (a) is a plot showing a meridional scan through the 002 diffraction peak of a commercial SPECTRA® 1000 polyethylene yarn at a temperature of −60° C. under no load; and (b) is a plot showing a meridional scan through the 002 diffraction peak of a commercial SPECTRA® 1000 yarn at a temperature of −60° C. under tensile strain just short of the yarn breaking strain. SPECTRA® 1000 is a commercial product of Honeywell International Inc., in Colonial Heights, Va.
Figure 3B:
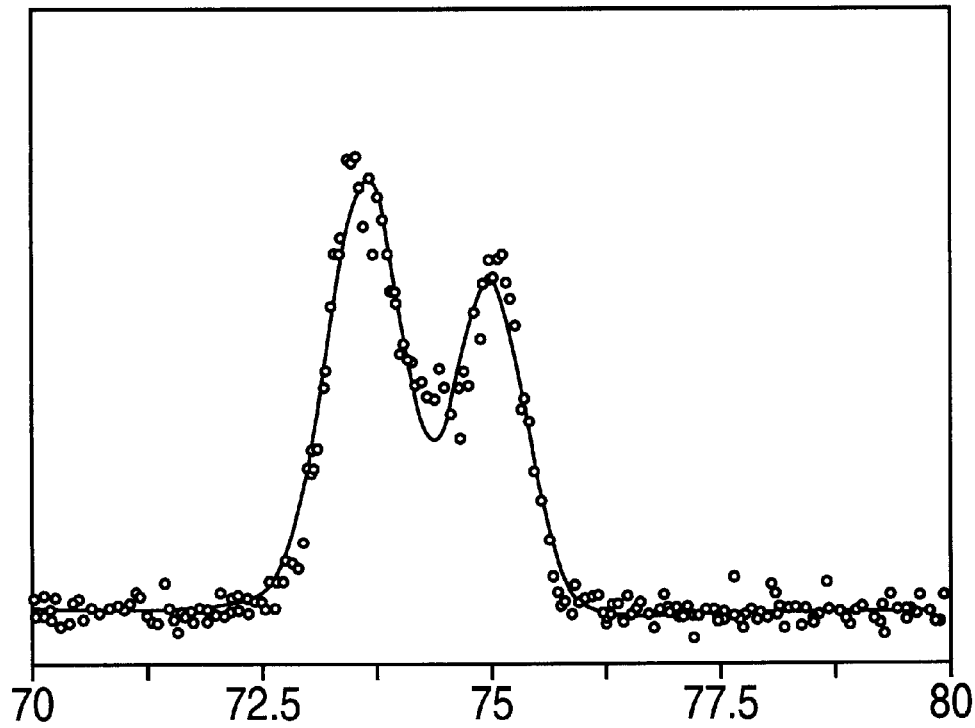

The microstructure of prior art yarns and the yarn of Example 6 were subjected to analysis by wide angle x-ray diffraction. FIG. 3*a* shows a meridional scan through the 002 diffraction peak of a commercial SPECTRA® 1000 yarn manufactured by Honeywell International Inc. at a temperature of −60° under no load. FIG. 3*b* shows the same peak under tensile strain just short of the yarn breaking strain. It is seen that the 002 reflection has shifted and split. The higher angle peak corresponds to a low strain crystalline component, while the lower angle peak corresponds to a high strain crystalline component. The proportion of the high strain crystalline component (measured by the relative peak areas) is 58%.

Figure 4:
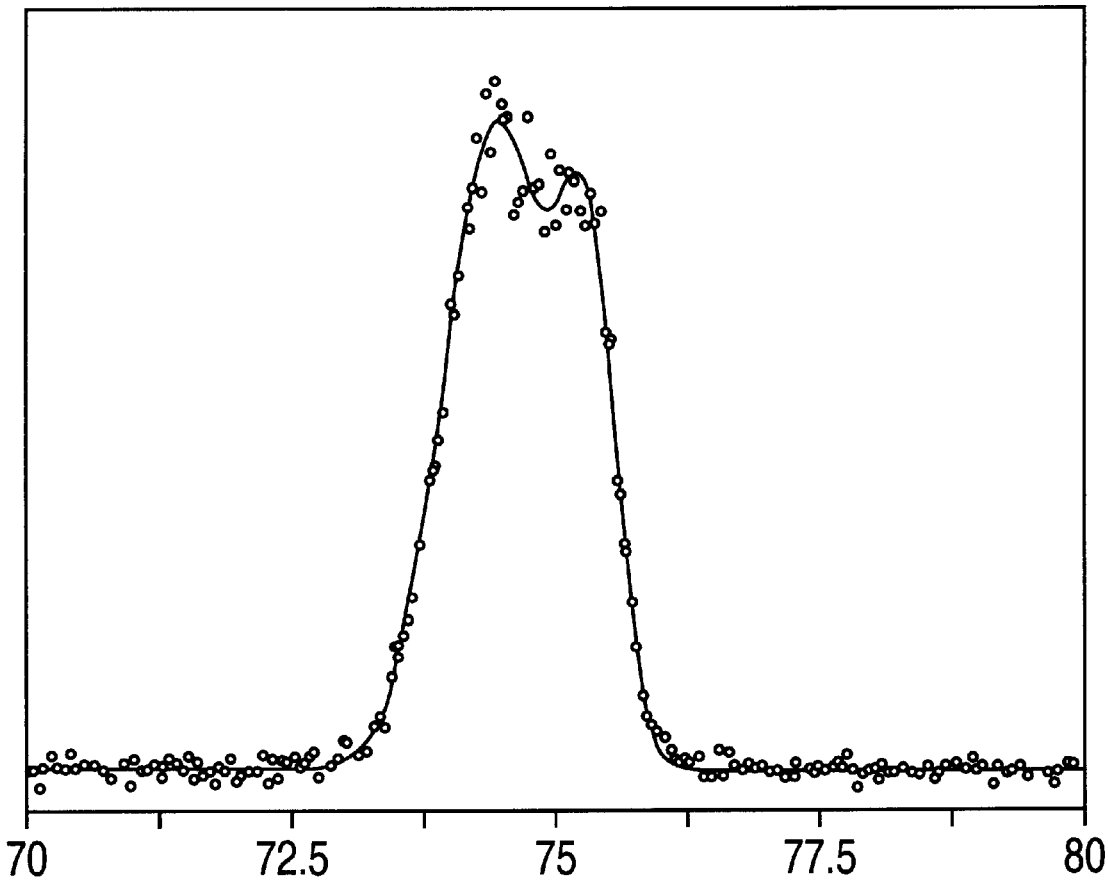
FIG. 4 is a plot showing the results from a wide angle x-ray diffraction of a meridional scan through the 002 diffraction peak of a DYNEEMA® SK77 high modulus polyethylene yarn at a temperature of −60° C. under tensile strain just short of the breaking strain. DYNEEMA® SK77 is a commercial product of DSM HPF of The Netherlands.

FIG. 4 shows a meridional scan through the 002 diffraction peak of a DYNEEMA® SK77 high modulus polyethylene yarn at −60° C. under tensile strain just short of the breaking strain. It is seen that proportion of the high strain crystalline component is just over 50%.

Figure 5A:
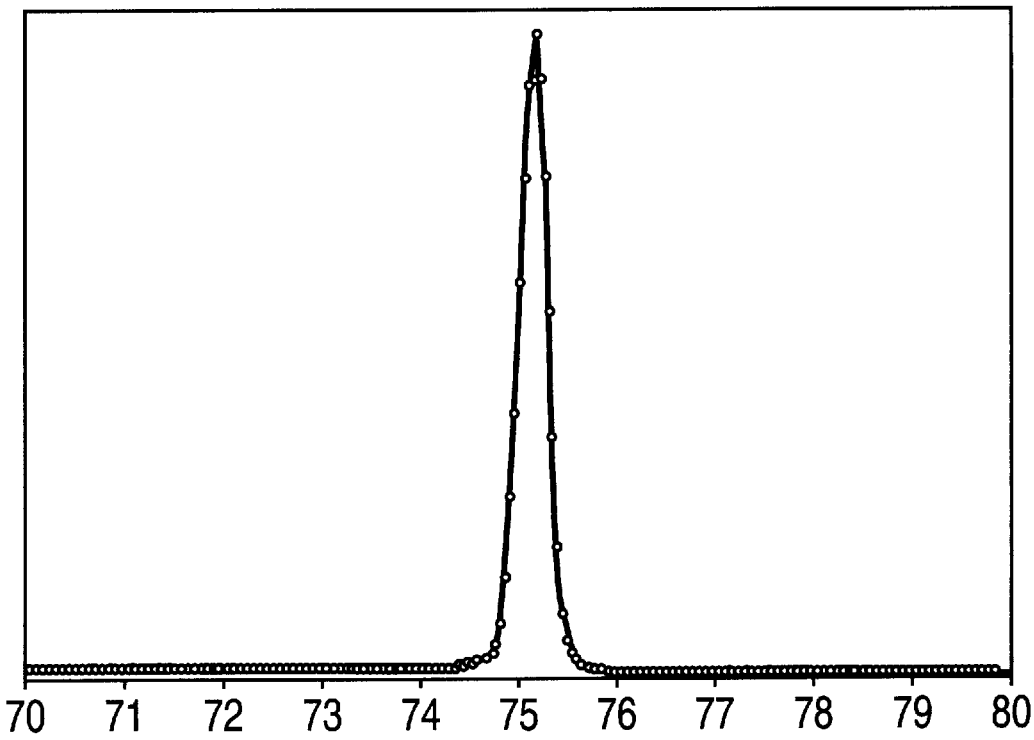
FIG. 5 shows the results from a wide angle x-ray diffraction study where (a) is a plot showing a meridional scan through the 002 diffraction peak of a yarn of Example 6 at a temperature of −60° C. under no load; and (b) is a plot showing the same peak under tensile strain just short of the yarn breaking strain.
Figure 5B:
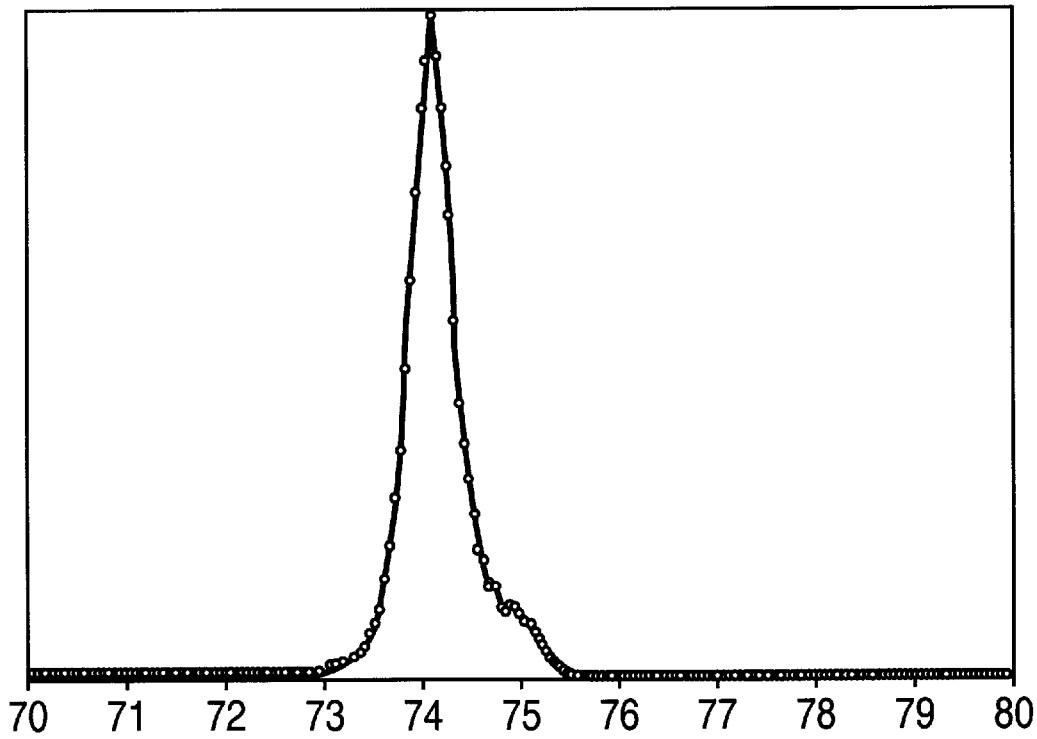

FIG. 5*a* shows a meridional scan through the 002 diffraction peak of the yarn of Example 6 at a temperature of −60° C. under no load. FIG. 5*b* shows the same peak under tensile strain just short of the yarn breaking strain. The proportion of the high strain crystalline component is 85%. Other yarns have not shown this high percentage of the high strain crystalline component.

B. Monoclinic Content

The monoclinic crystalline contents of a number of other high modulus polyethylene yarns and the yarn of Example 6 have been determined by wide angle x-ray diffraction. The results are shown in Table II.

TABLE II

| Yarn | Monoclinic, % |
|---|---|
| SPECTRA ® 900 | <0.5 |
| SPECTRA ® 1000 | 0.74 |
| Dyneema ® SK75 | 1.8 |
| Dyneema ® SK 77 | 1.8 |
| Example 6 | 4.1 |

It is seen that the proportion of monoclinic crystalline content of the yarn of Example 6 far exceeded the other, commercially available high modulus, polyethylene yarns.

C. Anti-ballistic Properties

Four ends of the 60 filament yarn of Example 6 were plied to create a 240 filament yarn. This yarn was used to construct a flexible composite panels for comparative testing with a standard commercially available SPECTRA SHIELD® composite panel, for ballistic effectiveness against two different projectiles. Both panels were constructed with the same fiber volume fraction and the same matrix resin. The tests with a 17 grain fragment employed a 22 caliber, non-deforming steel fragment of specified weight, hardness and dimensions (Mil-Spec. MIL-P 46593A (ORD)).The tests with 0.38 caliber bullets were conducted in accord with test procedure NILECJ-STD-0101.01. The protective power of a structure is normally expressed by citing the impact velocity at which 50% of the projectiles are stopped, and is designated the V50 value. Another useful measure of the effectiveness of a ballistic resistant composite is the ratio of the kinetic energy of a projectile at the V50 velocity to the areal density of the composite (ADC). That ratio is designated as the Specific Energy Absorption of the Composite (SEAC). The results of the ballistic firing tests are shown in Table III.

TABLE III

| | 17 gr. Fragment ADC = 7.0 Kg/m$^2$ | | 38 cal. Bullet ADC = 1.1 Kg/m$^2$ | |
|---|---|---|---|---|
| Composite | V50 ft/s | SEAC, J-m$^2$/Kg | V50 ft/s | SEAC, J-m$^2$/Kg |
| SPECTRA SHIELD ® | 2092 | 32.0 | 720 | 235 |
| Example 6 Yarn Shield | 2766 | 55.9 | 1038 | 466 |
| % Improvement | 32 | 75 | 44 | 98 |

It will be seen that the composite prepared from the Example 6 yarn was of remarkably improved anti-ballistic properties as compared to other commercial standards.

Figure 6:
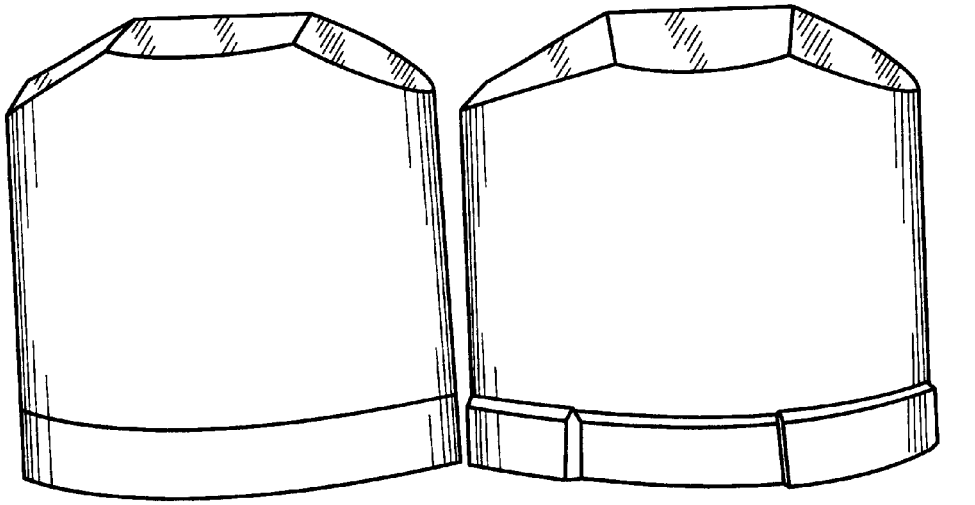
FIG. 6 depicts the projectiles after testing against targets of commercial SPECTRA SHIELD® material and a composite panel prepared from yarn of Example 6 of the present invention.

The 17 grain fragment is a hardened steel projectile. FIG. 6 is a photograph of the projectiles after they were tested against the above targets. It will be seen that the projectile stopped by the Example 6 yarn composite was deformed by the impact. The projectile stopped by the other commercial standard product was undeformed. This too is indicative of the superior anti-ballistic properties of the yarns of the invention.

It will be readily understood by those persons skilled in the art that the present invention is susceptible to broad utility and application. Many embodiments and adaptations of the present invention other than those herein described, as well as many variations, modifications and equivalent arrangement, will be apparent from or reasonably suggested by the present invention and the foregoing description without departing from the substance or scope of the present invention.

Accordingly, while the present invention has been described in detail in relation to its preferred embodiment, it is to be understood that this disclosure is only illustrative and exemplary of the present invention and is made merely for purposes of providing a full and enabling disclosure of the invention. The foregoing disclosure is not intended to be construed to limit the present invention or otherwise exclude any other embodiments, adaptations, variations, modifications or equivalent arrangements, the present invention being limited only by the claims and the equivalents thereof.

What is claimed is:

1. A polyethylene multi-filament yarn having a tenacity of at least about 35 g/d, a modulus of at least 1600 g/d, a work-to-break of at least about 65 J/g, as measured by ASTM D2256, wherein said yarn has a microstructure containing a high strain orthorhombic crystalline component comprising more than about 60% of the orthorhombic crystalline component.

2. The multi-filament yarn of claim 1 wherein the yarn has a modulus between about 1800 g/d and about 2500 g/d.

3. The multi-filament yarn of claim 1 wherein the yarn has a tenacity between about 35 g/d and about 60 g/d.

4. A polyethylene multi-filament yarn having a tenacitly of at least about 35 g/d, a modulus of at least 1600 g/d, a work-to-break of at least about 65 J/g, as measured by ASTM D2256, wherein said yarn has a microstructure containing a monoclinic crystalline component greater than about 2% of the crystalline content.

5. The multifilament yarn of claim 4 wherein the yarn has a modulus between about 1800 g/d and about 2500 g/d.

6. The multi-filament yarn of claim 4 wherein the yarn has a tenacity between about 35 g/d and about 60 g/d.

7. A polyethylene multi-filament yam having a tenacity of at least about 35 g/d, a modulus of at least 1600 g/d, a work-to-break of at least about 65 J/g, as measured by ASTM D2256, wherein said yarn has a microstructure containing a high strain orthorhombic crystalline component comprising more than about 60% of the orthorhombic crystalline component and a monoclinic crystalline component greater than about 2% of the crystalline content.

8. The yarn according to claim 7 comprising about 60 polyethylene filaments and having a tenacity of about 45 g/d and a modulus of about 2200 g/d.

9. A composite panel comprising the polyethylene yarn of claim 7.

* * * * *